US005327685A

United States Patent [19]

Chang

[11] Patent Number: 5,327,685

[45] Date of Patent: Jul. 12, 1994

[54] ELECTRIC DRILL COMPLETED WITH A SET OF GRINDING EQUIPMENTS

[76] Inventor: Wan-Li Chang, No. 227, Min-Chuan W. Road, Taipei, Taiwan

[21] Appl. No.: 63,666

[22] Filed: May 20, 1993

[51] Int. Cl.[5] ..... B24B 3/26; B25F 3/00

[52] U.S. Cl. ..... 51/5 E; 51/219 PC; 51/181 R

[58] Field of Search ..... 51/5 E, 5 R, 219 R, 51/219 PC, 241 R, 181 R

[56] References Cited

U.S. PATENT DOCUMENTS 1,475,153 11/1923 Athenas ..... 51/5 E 4,850,150 7/1989 Bishop ..... 51/219 R

*Primary Examiner*—Roscoe V. Parker

[57] ABSTRACT

The present disclosure relates to an electric drill characterized by a set of grinding equipments accommodated in an extended rear compartment of a housing of the electric drill. The set of grinding equipments mainly consists of a grinding wheel, a side cover having a through hole and an arcuate slot separately formed at proper positions, a cam capable of up-and-down and back-and-forth motion at some predetermined angles, a jig holder having a member to sequentially pass through a through hole of the cam and the through hole on the side cover and thereby becomes firmly associated with the cam and the side cover, and a drill jig being securely positioned and retained within retaining holes of the jig holder. The set of grinding equipments, when not in use, is concealed in the rear compartment, and, when it is to be used to grind a drill bit, the side cover is opened outward to expose the jig holder and the drill jig, the drill bit to be ground is inserted into a chunk of the drill jig, then the electric drill is powered so that a rotating shaft of the electric drill drives the grinding wheel to turn and grind the drill bit. The set of grinding equipments only occupies small room while it can timely and conveniently grind a drill bit in use.

5 Claims, 4 Drawing Sheets

ELECTRIC DRILL COMPLETED WITH A SET OF GRINDING EQUIPMENTS

BACKGROUND OF THE INVENTION

The present invention relates to an electric drill, and more particularly to an electric drill which has a rear compartment for accommodating a set of grinding means that occupies only small room and is ready for use at any time.

FIG. 1 illustrates a conventional electric drill 1, the front end of which securely holds and clamps a drill bit 11 for pressing and drilling a piece of work. Since the drill bit 11 always works under high speed and higher pressure, its head end, after long period of use, tends to have worn lip angle, lip clearance angle, and cutting edges. At this point, it is necessary to grind the drill bit 11 with a grinding means 13 having a grinding wheel 12. Most of the conventional grinding means 13 would require a support 14 or a simple working table. In a more complete grinding means 13, a jig 15 is provided to facilitate an grinding operator to actually control all working angles needed by a grind drill 11. It is therefore desirable to have the grinding means 13 provided at the site where electric drills 1 are required to drill holes, or, standard or ground drill bits 11 must be prepared in advance so that they are ready to substitute for those worn ones without delaying working progress. However, since a complete grinding means 13 is expensive in cost and is usually bulk in volume and not easy to move, it is usually provided only in larger working sites, such as plants. For working sites other than plants, ground drill bits in different sizes are carried based on the operator's experience and memory to meet incidental requirement lest the work under going should stop.

In view of the existing disadvantages and inconvenience that a worn drill bit can not be ground anywhere at any time due to the fact an electric drill and a grinding means 13 are separately provided, it is therefore tried by the inventor to develop an electric drill completed with a set of grinding equipments.

SUMMARY OF THE INVENTION

A primary object of the present invention is to provide an electric drill which has a rear compartment for accommodating a set of grinding equipments so that worn drill bits may be immediately and conveniently ground while the set of grinding equipments only occupies small room.

Another object of the present invention is to provide an electric drill having a rear compartment for accommodating grinding equipments. The rear compartment has a side cover pivotly connected to one side of the compartment by means of an upper and a lower receiving means. The lower receiving means is substantially a receiving pipe the top outer periphery of which is formed with a plurality of adequately spaced teeth and accordingly grooves. With these spaced teeth and grooves, the side cover of the rear compartment may be outward opened to a certain adequate angle matching the half lip angle of the drill bit so that the lip angle may be precisely ground.

A further object of the present invention is to provide the above electric drill in which the side cover of the rear compartment is provided with an arcuate slot which allows the ground drill bit to have a precise lip clearance angle.

A still further object of the present invention is to provide the above electric drill in which a jig holder having retaining holes is fixedly attached to inner side of the side cover for holding a jig which has a front and a rear circumferential recesses the span of which is preferably one half of the circumference of the jig so as to effectively control the forming of precise lip angle and helical angle when grinding the drill bit. And, each of the retaining holes has a head pin protruding toward a center of the retaining hole.

BRIEF DESCRIPTION OF THE DRAWINGS

The detailed structure, basic principle, functions, and advantages of the present invention can be best understood from the following detailed description of the preferred embodiment and the accompanying drawings wherein.

DETAILED DESCRIPTION OF THE PREFERRED EMBODIMENTS

Figure 1:
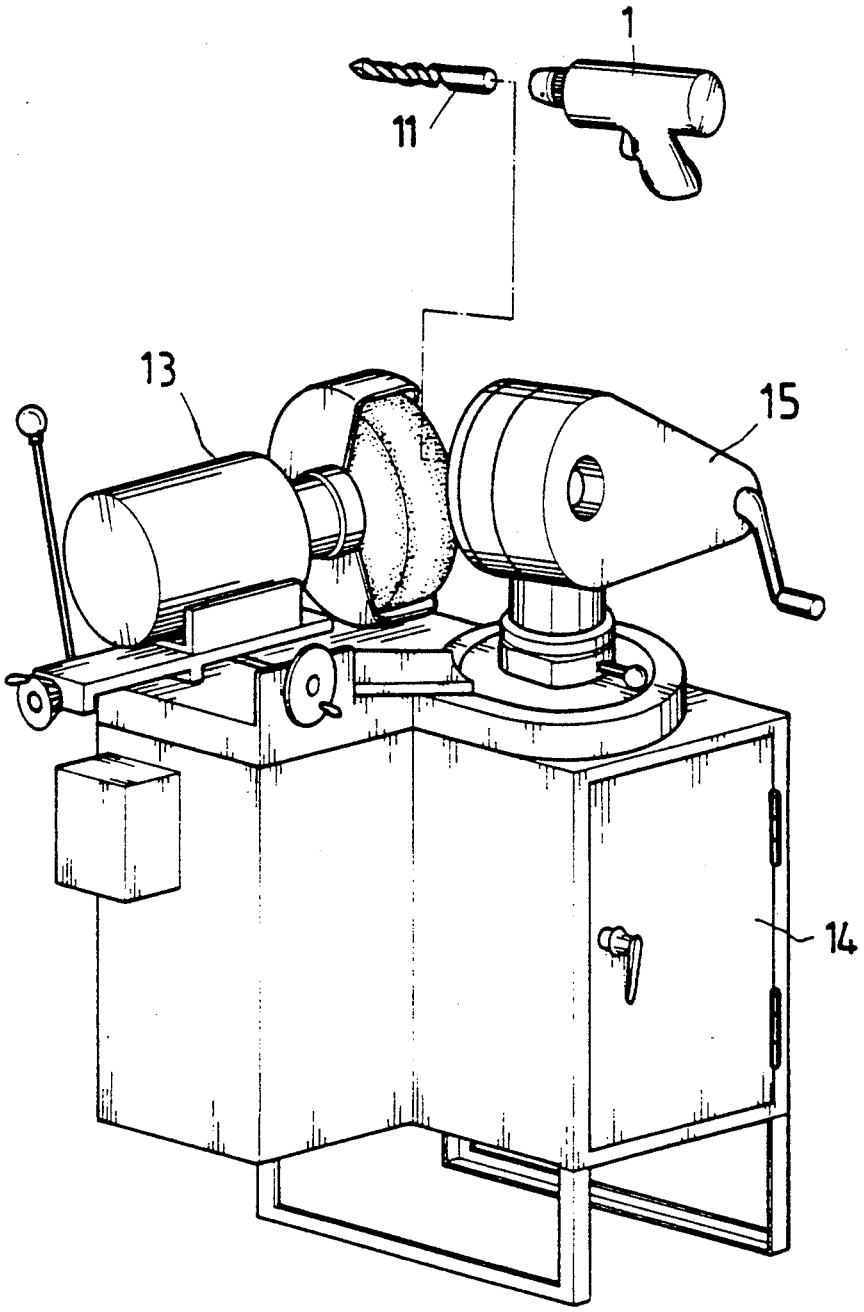
FIG. 1 PRIOR ART
FIG. 1 is a perspective of a conventional grinding wheel on a working table.
Figure 2:
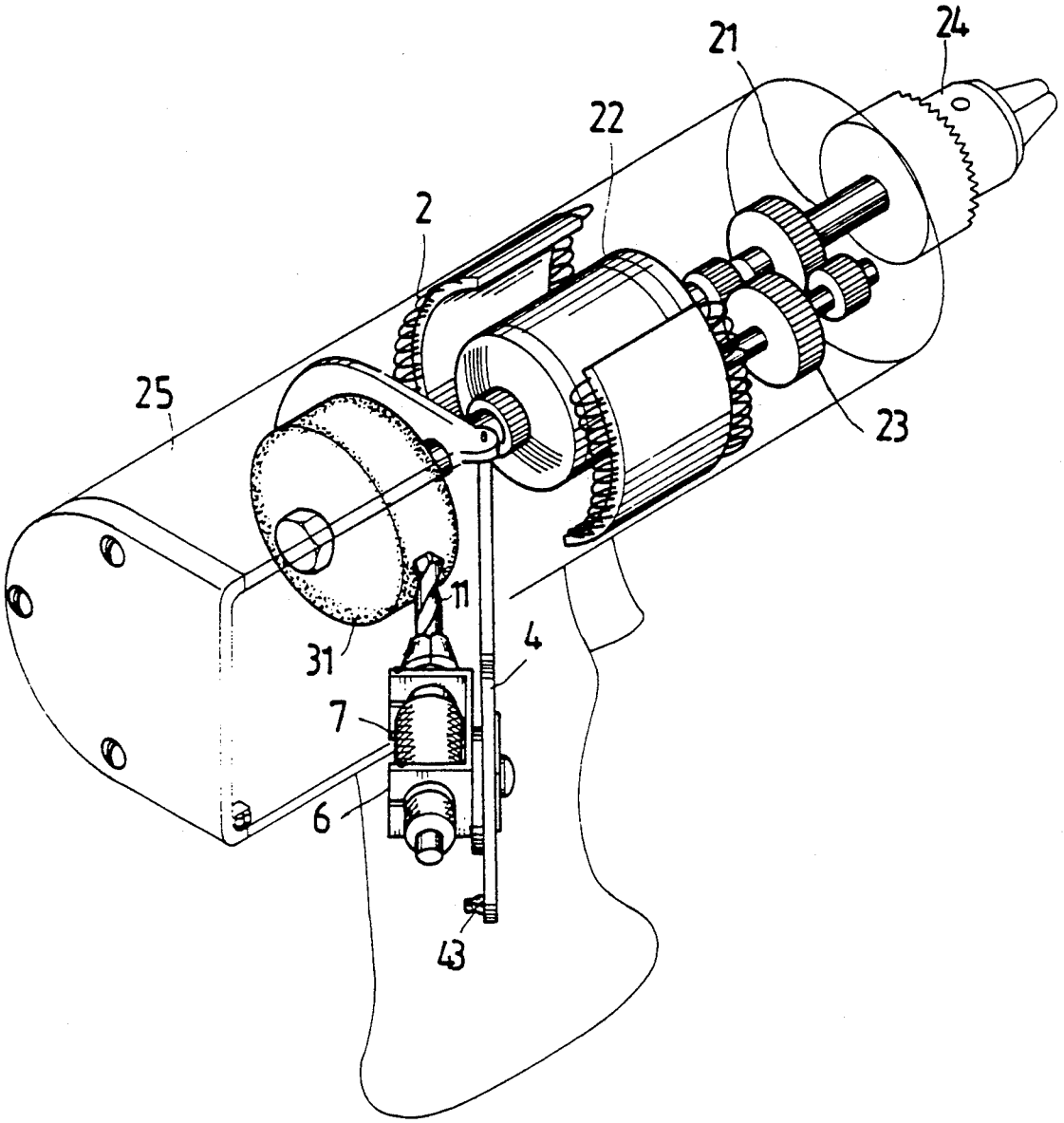
FIG. 2 is a perspective of an electric drill according to the present invention in which a set of grinding equipments is included in a rear compartment of the housing of the electric drill.
Figure 3:
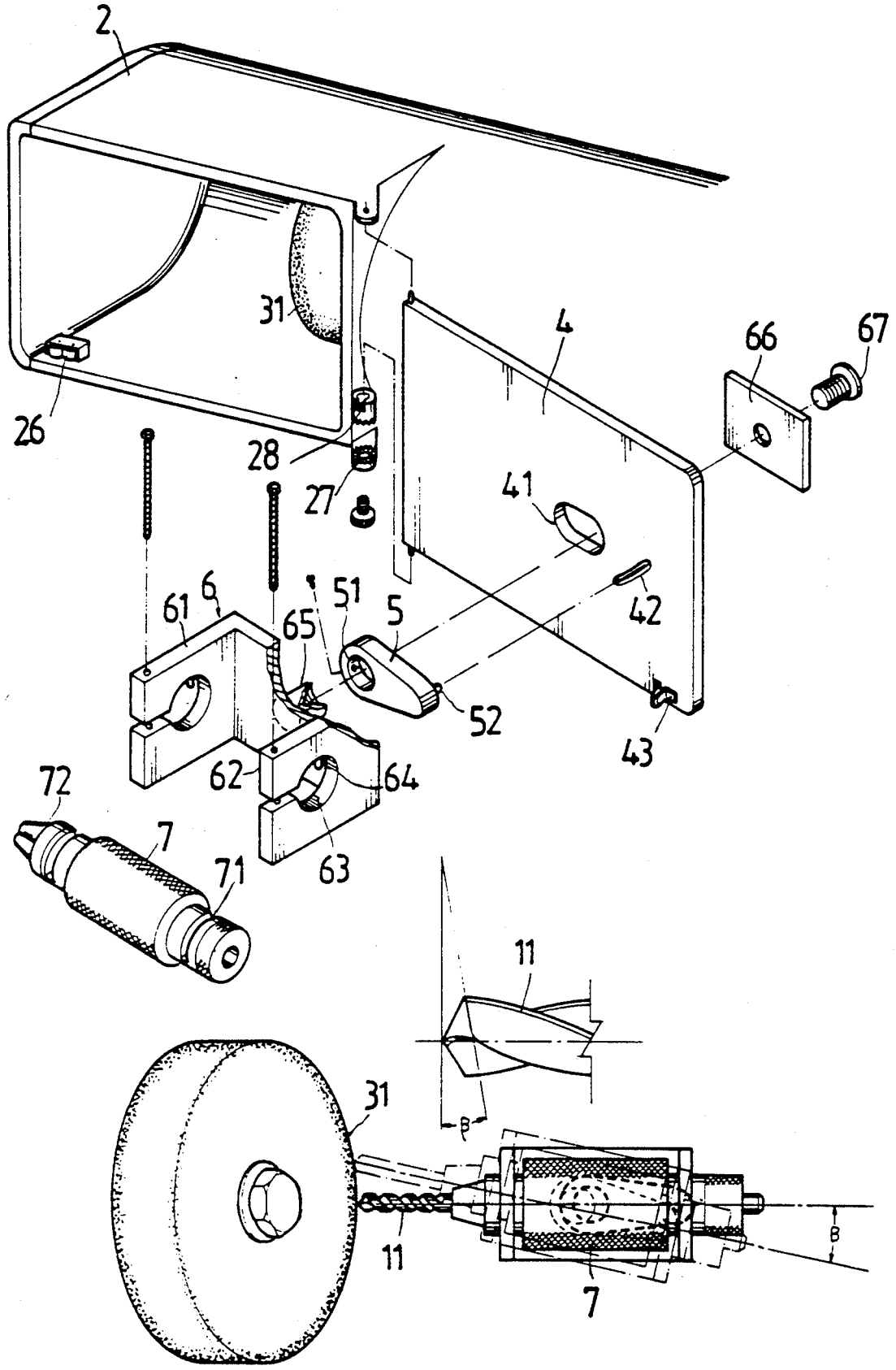
FIG. 3 includes a partial, disassembled perspective of the present invention showing the rear compartment thereof for accommodating a set of grinding equipments, and a perspective showing the operation of grinding a drill bit by means of the set of grinding equipments.

Please refer to FIGS. 2, 3. An electric drill according to the present invention has a housing 2 within which a rotor 22, a rotating shaft 21 passing through the rotor 22 with one front end extending out of the housing 2 , and a plurality of transmission gears are provided to cause a chuck 24 outside the housing 2 secured to the head end of the rotating shaft 21 to drive a drill bit held by the chuck 24 to press and drill a piece of work. The housing 2 of the electric drill extends backward to form a rear compartment 25 to accommodate therein a set of grinding equipments 3 which mainly includes a grinding wheel 31, a side cover 4, a cam 5, a jig holder 6, and a drill jig 7.

The rotating shaft 21 extends from its rear end into the rear compartment 25 to pivotly support the grinding wheel 31. The rear compartment 25 has a sideward opening which can be closed by the side cover 4. A catch 26 is provided inside the rear compartment 25 near one rear corner adjacent to the side opening such that it engages with a retaining member 43 provided on the side cover 4 when the same is closed to cover the rear compartment 25 and thereby securely holds the side cover 4 to the housing 2. Outside one vertical edge of the opening of the rear compartment 25, an upper receiving means and a lower receiving pipe 27 are provided at a top end and a bottom end thereof, respectively, to receive the side cover 4 such that the side cover 4 is pivotly connected at one vertical edge to the opening of the rear compartment and is allowed to be freely opened outward. At upper outside periphery of the receiving pipe 27, a plurality of adequately spaced teeth 28 and, accordingly, grooves are formed. The space between every two teeth 28 matches the half lip angle of the drill bit. On the side cover 4, a horizontal oblong through hole 41 and an arcuate slot 42 with a predetermined curvature are formed at proper positions.

The cam 5 has a through hole 51 formed at an end with larger width such that the hole 51 corresponds to the hole 41 on the side cover 4. The cam 5 further has a projected pin 52 provided at the other narrower end thereof, corresponding to and normal to the arcuate slot 42 on the side cover 4 such that the projected pin 52 may extend into the arcuate slot 42 and slidably moves at a certain angle therein.

The jig holder 6 is a substantially n-shaped frame. On two opposite side walls 61, 62 of the jig holder 6, each is provided with a freely adjustable retaining hole 63. Each of the retaining holes 63 has a head pin 64 projecting toward a center of the retaining hole 63. A back wall of the jig holder 6 connecting the two side walls 61, 62 thereof has an internally threaded sleeve 65 horizontally and outward projecting therefrom. The sleeve 65 passes through the hole 51 on the cam 5 and the hole 41 on the side cover 4 in sequence. By tightening a washer 66 and a screw 67 to the sleeve 65 through the holes 41, 51, the cam 5 is tightly supported on the sleeve 65 and secured between the jig holder 6 and the side cover 4.

The drill jig 7 is substantially a tubular member having a central through bore. Two circumferential recesses 71, preferably 180 degrees in span, are separately formed at a front and a rear ends of the drill jig 7. With the circumferential recesses 71 separately engaging with the retaining holes 63 and stopped by the head pins 64 of the jig holder 6, the drill jig 7 is allowed to turn within a predetermined angle. The drill jig 7 further has an adjustable chuck 72 to securely hold a drill bit 11 therein.

Figure 4:
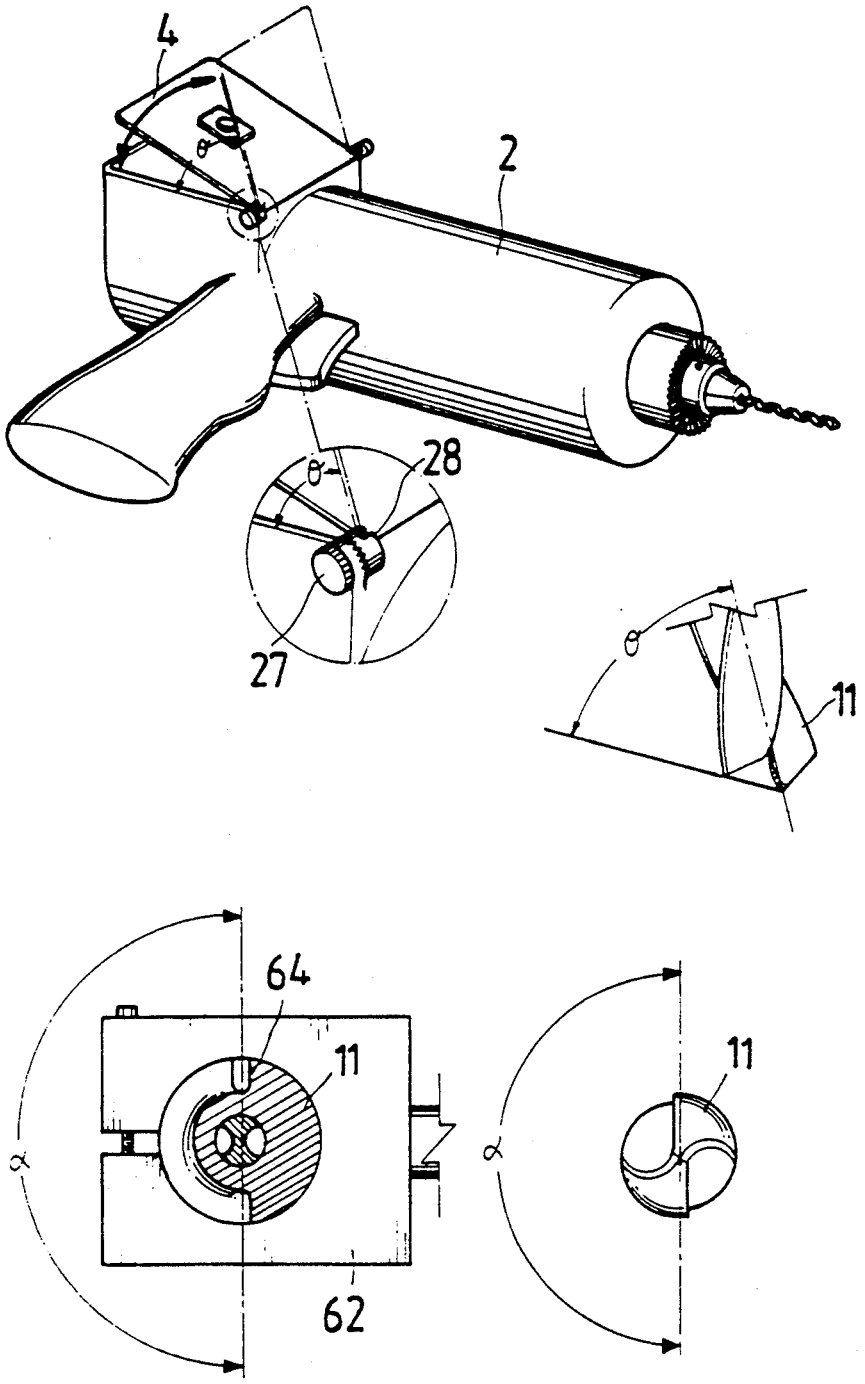
FIG. 4 includes a perspective of the present invention with the side cover of the rear compartment opened to a certain angle, and fragmentary, enlarged views showing different grinding angles to be ground.

The set of grinding equipments 3, when it is not in use, is concealed in the rear compartment 25 of the housing 2. To grind a drill bit 11, just outward open the side cover 4, as shown in FIG. 4. At this point, slightly lift the side cover 4, permitting the same to separate from the teeth 28 of the receiving pipe 27, then, continue to turn the side cover 4 outward with the same being kept in lifted position until the side cover 4 is moved to above some proper tooth 28, permitting the angle between the side cover 4 and the circumferential surface of the grinding wheel 31 to be equal to the half lip angle $\theta$ of the drill bit 11 to be ground. Lower down the side cover 4. Insert the drill bit 11 to be ground into the jig 7 and start the electric drill. The rotating shaft 21 drives the grinding wheel 31 to turn and the grinding of the drill bit 11 can be started now. During grinding the half lip angle $\theta$ of the drill bit 11, the lip clearance angle $\beta$ of the drill bit 11 must be ground, too. To do this, the grinding operator may feed, move back, and circularly turn up and down the drill bit 11 relative to the grinding wheel 31 by adjusting the jig holder 6, and accordingly the cam 5, within the range provided and limited by the oblong through hole 41 and the arcuate slot 42. And, by means of the circumferential recesses 71 on the jig 7, the drill bit 11 held by the jig 7 may be turned an angle equal to the helical angle of the drill bit 11 and thereby, be precisely ground under effective control. By this way, the electric drill according to the present invention can timely and conveniently provide drill bit grinding means while only small room is occupied by the additional grinding means.

We claim:

1. An electric drill completed with a set of grinding equipments, comprising:

a housing, within which a rotor, a rotating shaft passing through said rotor with one front end extending out of said housing, and a plurality of transmission gears being provided to cause a chuck outside said housing and secured to the head end of said rotating shaft to drive a drill bit held by said chuck to press and drill a piece of work; said housing extending backward to form a rear compartment to accommodate therein a set of grinding equipments which mainly includes a grinding wheel, a side cover, a cam, a jig holder, and a drill jig;

said grinding wheel being pivotly supported by said rotating shaft on a rear end thereof which backward extends into said rear compartment and being capable of turning along with said rotating shaft so as to grind a drill bit;

said side cover being pivotly connected at a vertical edge thereof to a side opening of said rear compartment such that said side cover closes said rear compartment and can be freely opened outward; said side cover further having an horizontal oblong through hole and an arcuate slot formed thereon at proper positions;

said cam having a through hole formed at an end with larger width such that said through hole corresponds to said horizontal oblong hole on said side cover, and a projected pin provided at the other narrower end of said cam, corresponding to and normal to said arcuate slot on said side cover such that said projected pin may extend into said arcuate slot and slidably moves at a certain angle therein;

said jig holder being a substantially n-shaped frame, having two opposite side walls each of which being provided with a freely adjustable retaining hole in which a head pin projecting toward a center of said retaining hole is provided, and a back wall connecting said two side walls having an internally threaded sleeve horizontally projecting outward therefrom; said sleeve further passing through said through hole on said cam and said oblong hole on said side cover in sequence, permitting said jig holder, said cam, and said side cover to firmly associate with other; and said drill jig being substantially a tubular member having a central through bore and an adjustable chuck at a front head thereof, and being separately formed near a front and a rear ends thereof two circumferential recesses which, preferably 180 degrees in span, separately engages with said retaining holes of said jig holder;

said set of grinding equipments being concealed within said rear compartment of said housing of said electric drill when it is not in use; said side cover thereof being opened outward first when said set of grinding equipments is used to grind a drill bit, then said drill bit to be ground being inserted into said chuck of said drill jig before said electric drill is powered to turn said rotating shaft so that said rotating shaft drives said grinding wheel to turn and grind said drill bit.

2. An electric drill completed with a set of grinding equipments as claimed in claim 1, wherein said rear compartment has a catch provided at a corner thereof, corresponding to a retaining means provided on said side cover, permitting said side cover to securely close and be held to said rear compartment.

3. An electric drill completed with a set of grinding equipments as claimed in claim 1, wherein said side cover is pivotly connected at bottom end to said rear compartment by means of a receiving pipe an upper outer periphery of which is formed of a plurality of adequately spaced teeth and grooves, accordingly; said adequately spaced teeth on said receiving pipe permitting said side cover, when to be opened, to be turned to an adequate angle which matches a half lip angle of said drill bit and thereby, allowing said drill bit held in said drill jig to be ground to form a precise lip angle.

4. An electric drill completed with a set of grinding equipments as claimed in claim 1, wherein said arcuate slot on said side cover has a curvature matching a standard lip clearance angle of said drill bit, and preferably has a curvature of 12 degrees.

5. An electric drill completed with a set of grinding equipments as claimed in claim 1, wherein said retaining holes of said jig holder each has a head pin projecting toward a center of said retaining hole and capable of stopping either of said circumferential recesses formed at front and rear ends of said drill jig; said circumferential recesses are preferably 180 degrees in span so that the grinding of said lip angle and a helical angle of said drill bit is done under effective control.

* * * * *